US009269507B2

(12) United States Patent
Enomoto et al.

(10) Patent No.: US 9,269,507 B2
(45) Date of Patent: Feb. 23, 2016

(54) SPRING LOAD ADJUSTMENT STRUCTURE OF CONTACT DEVICE AND SPRING LOAD ADJUSTMENT METHOD OF CONTACT DEVICE

(71) Applicant: Panasonic Intellectual Property Management Co., Ltd., Osaka (JP)

(72) Inventors: Hideki Enomoto, Nara (JP); Hirokazu Asakura, Mie (JP); Tetsuya Yamada, Mie (JP); Ritsu Yamamoto, Mie (JP); Naoki Seki, Mie (JP); Toshiyuki Shima, Mie (JP); Naoki Inadomi, Mie (JP); Yoji Ikeda, Hokkaido (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/390,326

(22) PCT Filed: Apr. 8, 2013

(86) PCT No.: PCT/JP2013/002393

§ 371 (c)(1),
(2) Date: Oct. 2, 2014

(87) PCT Pub. No.: WO2013/153799

PCT Pub. Date: Oct. 17, 2013

(65) Prior Publication Data

US 2015/0077202 A1 Mar. 19, 2015

(30) Foreign Application Priority Data

Apr. 9, 2012 (JP) ..... 2012-088838

(51) Int. Cl.

| | |
|---|---|
| ***H01H 9/20*** | (2006.01) |
| ***H01H 1/50*** | (2006.01) |
| ***H01H 1/54*** | (2006.01) |
| ***H01H 50/54*** | (2006.01) |

(Continued)

(52) U.S. Cl.
CPC . *H01H 1/50* (2013.01); *H01H 1/54* (2013.01); *H01H 50/546* (2013.01); *H01H 1/20* (2013.01); *H01H 49/00* (2013.01); *H01H 2050/025* (2013.01)

(58) Field of Classification Search
CPC ..... H01H 50/64; H01H 50/30; H01H 50/36; H01H 50/60; H01H 2201/022; H01H 33/70; H01H 47/00; H01R 11/30; H01R 13/02
USPC ..... 335/171
See application file for complete search history.

(56) References Cited

U.S. PATENT DOCUMENTS

| | | | | |
|---|---|---|---|---|
| 5,892,194 | A * | 4/1999 | Uotome | H01H 1/34 218/68 |
| 2004/0027776 | A1 * | 2/2004 | Uotome | H01H 47/06 361/160 |

(Continued)

FOREIGN PATENT DOCUMENTS

| | | | |
|---|---|---|---|
| JP | 2004-303633 | A | 10/2004 |
| JP | 2012-048907 | A | 3/2012 |
| JP | 2012-048908 | A | 3/2012 |

OTHER PUBLICATIONS

International Search Report issued in PCT/JP2013/002393, dated May 7, 2013, with English translation.

*Primary Examiner* — Shawki S Ismail
*Assistant Examiner* — Lisa Homza
(74) *Attorney, Agent, or Firm* — McDermott Will & Emery LLP

(57) ABSTRACT

A contact device includes: fixed terminals; a movable contact maker; a pressing spring; an adjustment plate that comes into contact with an upper face of the movable contact maker; a holding portion; a movable shaft; and an electromagnet block. The holding portion is divided into first and second holding portions that are separated from each other. The first and second holding portions are electrically connected to each other via only the adjustment plate, due to the adjustment plate being sandwiched by a first side plate of the first holding portion and a second side plate of the second holding portion. The adjustment plate is moved in extending and contracting directions of the pressing spring, and the adjustment plate and each of the first and second side plates are subjected to resistance welding at a position at which pressing force of the pressing spring is a predetermined value.

20 Claims, 11 Drawing Sheets

(51) Int. Cl.

| | |
|---|---|
| *H01H 49/00* | (2006.01) |
| *H01H 1/20* | (2006.01) |
| *H01H 50/02* | (2006.01) |

(56) References Cited

U.S. PATENT DOCUMENTS

2006/0050466 A1* 3/2006 Enomoto ..... H01H 50/02 361/160
2009/0243771 A1* 10/2009 Uruma ..... H01H 50/04 335/193
2013/0012037 A1* 1/2013 Enomoto ..... H01H 9/443 439/39
2013/0115807 A1* 5/2013 Enomoto ..... H01H 1/54 439/539
2015/0194284 A1* 7/2015 Uruma ..... H01H 1/06 335/179
2015/0255235 A1* 9/2015 Nishimura ..... H01H 50/54 335/187

* cited by examiner

SPRING LOAD ADJUSTMENT STRUCTURE OF CONTACT DEVICE AND SPRING LOAD ADJUSTMENT METHOD OF CONTACT DEVICE

RELATED APPLICATIONS

This application is the U.S. National Phase under 35 U.S.C. §371 of International Application No. PCT/JP2013/002393, filed on Apr. 8, 2013, which in turn claims the benefit of Japanese Application No. 2012-088838, filed on Apr. 9, 2012, the disclosures of which Applications are incorporated by reference herein.

TECHNICAL FIELD

The present invention relates to a spring load adjustment structure of a contact device and a spring load adjustment method of a contact device.

BACKGROUND ART

Heretofore, contact device has been provided in which a movable shaft is moved in the axial direction due to turning on/off energization of an electromagnet block, and movable contacts are brought into contact with and separated from fixed contacts, in conjunction with movement of the movable shaft. The contact device includes a pressing spring that gives biasing force to the movable contacts toward the fixed contacts in order to secure pressing force between the contacts when the movable contacts are in contact with the fixed contacts (closed state).

In recent years, since downsizing of the contact device is desired, downsizing of individual parts of the contact device has been in progress, and the pressing spring has been downsized as well. Here, a coil spring is generally used as the pressing spring, and the coil spring is arranged in a state of being contracted by a predetermined length from the natural length. Then, when the pressing spring is downsized, since the pressing force working between the movable contacts and the fixed contacts decreases, a pressing spring having a high spring constant has been used in order to suppress reduction of the pressing force, while downsizing the pressing spring. The larger the spring constant of the pressing spring is, the larger the increase/decrease of the biasing force becomes relative to a change of an extension and contraction amount of the pressing spring.

However, when the contraction amount of the pressing spring (initial contraction amount) when the movable contacts are separated from the fixed contacts (open state) differs in each contact device, variability occurs in open state pressing force (initial pressing force) among the contact devices. Thus, there may be a contact device in which the pressing force in the closed state is less than a predetermined pressing force. Therefore, taking into consideration the variability of the pressing force among the contact devices, an electromagnet block that can generate stronger electromagnetic force needs to be provided in each contact device. Note that the initial pressing force refers to pressing force of the pressing spring against the movable contact maker when the movable contact is separated from the fixed contact (open state).

However, when the size of the electromagnet block is increased, the size of the contact device increases, thus making downsizing of the contact device difficult. Accordingly, the variability of spring loads needs to be reduced by making the initial contraction amounts of the pressing springs the same in the contact devices.

In view of this, a contact device that is capable of adjusting the spring load has been proposed (refer to JP 2012-48907A, for example). The contact device includes a configuration in which the movable contact maker and the pressing spring are sandwiched by an adjustment plate and a holding member, and the adjustment plate is fixed to the holding member by welding at a position at which the pressing force of the pressing spring is a predetermined value. This conventional contact device will be described with reference to FIGS. 10 and 11. Note that description will be given using upper, lower, right, and left in FIG. 10 as references, and the direction orthogonal to the upper and lower, and right and left directions is a front and rear direction.

The conventional contact device includes, as shown in FIGS. 10 and 11, fixed terminals 33 respectively including fixed contacts 32, a movable contact maker 35 including movable contacts 34, a pressing spring 36, an adjustment plate 61, a holding member 5A, a movable shaft 8, and an electromagnet block 2.

Each of the fixed terminals 33 is formed in a substantially columnar shape of a conductive material such as copper, and has the fixed contact 32 fixed to a lower end. Note that the fixed contact 32 may be formed integrally with the fixed terminal 33.

The movable contact maker 35 is formed in a substantially rectangular plate-like shape, and the movable contacts 34 are fixed to respective right and left end sides of an upper face thereof, the movable contacts 34 being arranged at positions opposing the respective fixed contacts 32 with a predetermined space. Also, a positioning protrusion 35*a* having a substantially disk-like shape is formed at approximately the center of the lower face of the movable contact maker 35.

The pressing spring 36 is constituted of a coil spring, and is arranged in a state in which an axial direction thereof is in the up and down direction, and is positioned relative to the movable contact maker 35 by the positioning protrusion 35*a* being fitted into an inner diameter portion on an upper end side.

The holding member 5A includes a bottom plate 51A, and a pair of side plates 52A that extend upward respectively from the front and rear edges of the bottom plate 51A and oppose each other in the front and rear direction, and thus has a substantially U-shaped cross section.

The bottom plate 51A is formed in a substantially rectangular plate-like shape, and an upper face thereof is in contact with a lower end of the pressing spring 36 and opposes the lower face of the movable contact maker 35 via the pressing spring 36. That is, the pressing spring 36 is sandwiched between the bottom plate 51A and the movable contact maker 35 in the up and down direction.

Each of the pair of side plates 52A is formed in a substantially rectangular plate-like shape. A front end of the movable contact maker 35 is in sliding contact with an inner face (rear face) of the front side plate 52A, and a rear end of the movable contact maker 35 is in sliding contact with an inner face (front face) of the rear side plate 52A.

The movable shaft 8 is formed in a substantially bar-like shape elongated in the up and down direction, the electromagnet block 2 is connected to a lower end, and an upper end is connected to the lower face of the bottom plate 51A at approximately the center thereof.

The adjustment plate 61 is formed in a substantially rectangular plate-like shape, is inserted between the pair of side plates 52A from above, and is mounted on an upper face of the movable contact maker 35 at approximately the center thereof. Then, by pressing the adjustment plate 61 downward, the adjustment plate 61 and the movable contact maker 35 move downward against biasing force of the pressing spring 36, and the pressing force of the pressing spring 36 against the movable contact maker 35 increases. Note that, hereinafter, the pressing force of the pressing spring 36 against the movable contact maker 35, when the movable contact 34 is separated from the fixed contact 32 (open state), is referred to as initial pressing force. Here, when the adjustment plate 61 is moved further downward, the initial pressing force can be increased more, and when the adjustment plate 61 is moved upward, the initial pressing force can be reduced.

Also, the front and rear ends of the adjustment plate 61 are respectively fixed to the pair of side plates 52A, at a position at which the initial pressing force is a predetermined value, by welding, for example. Accordingly, the initial pressing force can be adjusted easily.

Then, the movable contact maker 35 is pressed upward by the pressing spring 36, and the upper face thereof comes into contact with the adjustment plate 61 so that movement toward the fixed contacts 32 is restricted.

Resistance welding is generally known as a method of welding metals together. Resistance welding is a welding method in which a large electric current is applied to a welding portion, and the welding portion is welded by heating due to Joule heat generated at the contact point and by pressure applied simultaneously, and the welding time can be shortened.

However, in the conventional contact device, since the holding member 5A is formed to have a substantially U-shaped cross section, the side plates 52A, which is a pair, are brought into conduction via the bottom plate 51A. As a result, since the electric current that flows between each side plate 52A and the adjustment plate 61 decreases, it has been difficult to perform resistance welding between the holding member 5A (side plates 52A) and the adjustment plate 61.

DISCLOSURE OF INVENTION

The present invention has been made in view of the above-described problems, and an object of the present invention is to provide a spring load adjustment structure, in which an adjustment plate and a holding portion are easily welded, of a contact device and a spring load adjustment method of a contact device.

A spring load adjustment structure of a contact device according to the present invention is a spring load adjustment structure of the contact device that includes fixed terminals respectively including fixed contacts, a movable contact maker including, on one face thereof, movable contacts that are brought into contact with and separate from the respective fixed contacts, a pressing spring that extends and contracts in a moving direction of the movable contacts so as to bias the movable contact maker toward the fixed contacts, an adjustment plate that is in contact with the one face of the movable contact maker, a holding portion including a bottom plate that sandwiches the movable contact maker and the pressing spring with the adjustment plate in the moving direction of the movable contacts, and side plates, extending from the bottom plate, with which side ends of the movable contact maker are in sliding contact, a movable shaft, one end side thereof being coupled to the holding portion, and a driving unit that is configured to drive the movable shaft in an axial direction such that the movable contacts are brought into contact with and separate from the respective fixed contacts. The holding portion is divided into a first holding portion and a second holding portion. The bottom plate includes a first bottom plate provided to the first holding portion and a second bottom plate provided to the second holding portion. The side plates include a first side plate provided to the first holding portion and a second side plate provided to the second holding portion. The first and the second holding portions are provided in a state of being separated from each other, and by sandwiching the adjustment plate with the first side plate and the second side plate that are opposing to each other, the first and the second holding portions are electrically connected with each other via only the adjustment plate. A distance between the bottom plate and the adjustment plate is changed by moving the adjustment plate in extending and contracting directions of the pressing spring, and the adjustment plate and each of the first and second side plates are subjected to resistance welding at a position at which pressing force of the pressing spring against the movable contact maker is a predetermined value.

It is preferable that, in the spring load adjustment structure of a contact device, the bottom plate and the pressing spring are insulated from each other.

It is preferable that, in the spring load adjustment structure of a contact device, the contact device further includes a spring receiving portion provided between the bottom plate and the pressing spring, and the spring receiving portion is formed of a material having an electrical insulation property.

It is preferable that, in the spring load adjustment structure of a contact device, the first bottom plate and the first side plate, in the first holding portion, are continuous via a first bent portion, the second bottom plate and the second side plate, in the second holding portion, are continuous via a second bent portion, the spring receiving portion is provided to the bottom plate, and the first and second bent portions are exposed from the spring receiving portion.

It is preferable that, in the spring load adjustment structure of a contact device, the spring receiving portion includes planar faces that are opposing to each other on outer faces.

It is preferable that, in the spring load adjustment structure of a contact device, a first protrusion is formed on a first face, which opposes the second side plate, of the first side plate, and a second protrusion is formed on a second face, which opposes the first side plate, of the second side plate, and the adjustment plate and each of the first and the second side plates are subjected to projection welding in a state in which tips of the first and second protrusions are in contact with the adjustment plate.

It is preferable that, in the spring load adjustment structure of a contact device, the first protrusion is formed on a side of the first face of the first side plate by extrusion from a side of a third face, the third face being a face of the first side plate that is opposite to the first face, and the second protrusion is formed on a side of the second face of the second side plate by extrusion from a side of a fourth face, the fourth face being a face of the second side plate that is opposite to the second face.

It is preferable that, in the spring load adjustment structure of a contact device, a plurality of first protrusions, each of which is the first protrusion, are formed on the first side plate, and a plurality of second protrusions, each of which is the second protrusion, are formed on the second side plate.

It is preferable that, in the spring load adjustment structure of a contact device, the plurality of first protrusions are formed on the same plane of the first side plate, and the plurality of second protrusions are formed on the same plane of the second side plate.

It is preferable that, in the spring load adjustment structure of a contact device, the third face that is the face opposite to the first face, in the first side plate, is formed in a planar shape, and the fourth face that is the face opposite to the second face, in the second side plate, is formed in a planar shape.

It is preferable that, in the spring load adjustment structure of a contact device, the holding portion includes an opening portion opposing to the bottom plate in the moving direction of the movable contacts, and the adjustment plate that covers the opening portion is welded to each of the first and second side plates.

It is preferable that, in the spring load adjustment structure of a contact device, the adjustment plate is coated by plating.

It is preferable that, in the spring load adjustment structure of a contact device, the adjustment plate is formed of a magnetic material, and the holding portion is formed of a non-magnetic material.

A spring load adjustment method of a contact device according to the present invention is a spring load adjustment method of the contact device that includes fixed terminals respectively including fixed contacts, a movable contact maker including, on one face thereof, movable contacts that are brought into contact with and separate from the respective fixed contacts, a pressing spring that extends and contracts in a moving direction of the movable contacts so as to bias the movable contact maker toward the fixed contacts, an adjustment plate that is in contact with the one face of the movable contact maker, a holding portion including a bottom plate that sandwiches the movable contact maker and the pressing spring with the adjustment plate in the moving direction of the movable contacts, and side plates, extending from the bottom plate, with which side ends of the movable contact maker are in sliding contact, a movable shaft, one end side thereof being coupled to the holding portion, and a driving unit that is configured to drive the movable shaft in an axial direction such that the movable contacts are brought into contact with and separate from the respective fixed contacts. The holding portion is divided into a first holding portion and a second holding portion. The bottom plate includes a first bottom plate provided to the first holding portion and a second bottom plate provided to the second holding portion. The side plates include a first side plate provided to the first holding portion and a second side plate provided to the second holding portion. The first and the second holding portions are provided in a state of being separated from each other, and by sandwiching the adjustment plate with the first side plate and the second side plate that are opposing to each other, the first and the second holding portions are electrically connected with each other via only the adjustment plate. A distance between the bottom plate and the adjustment plate is changed by moving the adjustment plate in extending and contracting directions of the pressing spring, and the adjustment plate and each of the first and second side plates are subjected to resistance welding at a position at which pressing force of the pressing spring against the movable contact maker is a predetermined value.

As described above, the present invention has an effect that the adjustment plate and the holding portion (first and second holding portions) can be welded easily.

BRIEF DESCRIPTION OF DRAWINGS

A preferable embodiment according to the present invention will be described in more detail. Other features and advantages of the present invention will be better understood with reference to the following detailed description and the attached drawings.

BEST MODE FOR CARRYING OUT THE INVENTION

Hereinafter, an embodiment according to the present invention will be described with reference to the drawings.

Embodiment

A contact device of the present embodiment will be described with reference to FIGS. 1 to 4. Note that description will be given using upper, lower, right, and left in FIG. 1 as references, and the direction orthogonal to the upper and lower, and right and left directions is the front and rear direction. The up and down direction is an axial direction (first direction) of a movable shaft 8, the right and left direction is a direction in which movable contacts 34 are arranged side by side (second direction), and the front and rear direction is a third direction orthogonal to the first direction and the second direction. Also, in the up and down direction, upward and upward direction are defined as a first side in the first direction, and downward and downward direction are defined as a second side in the first direction.

Figure 1:
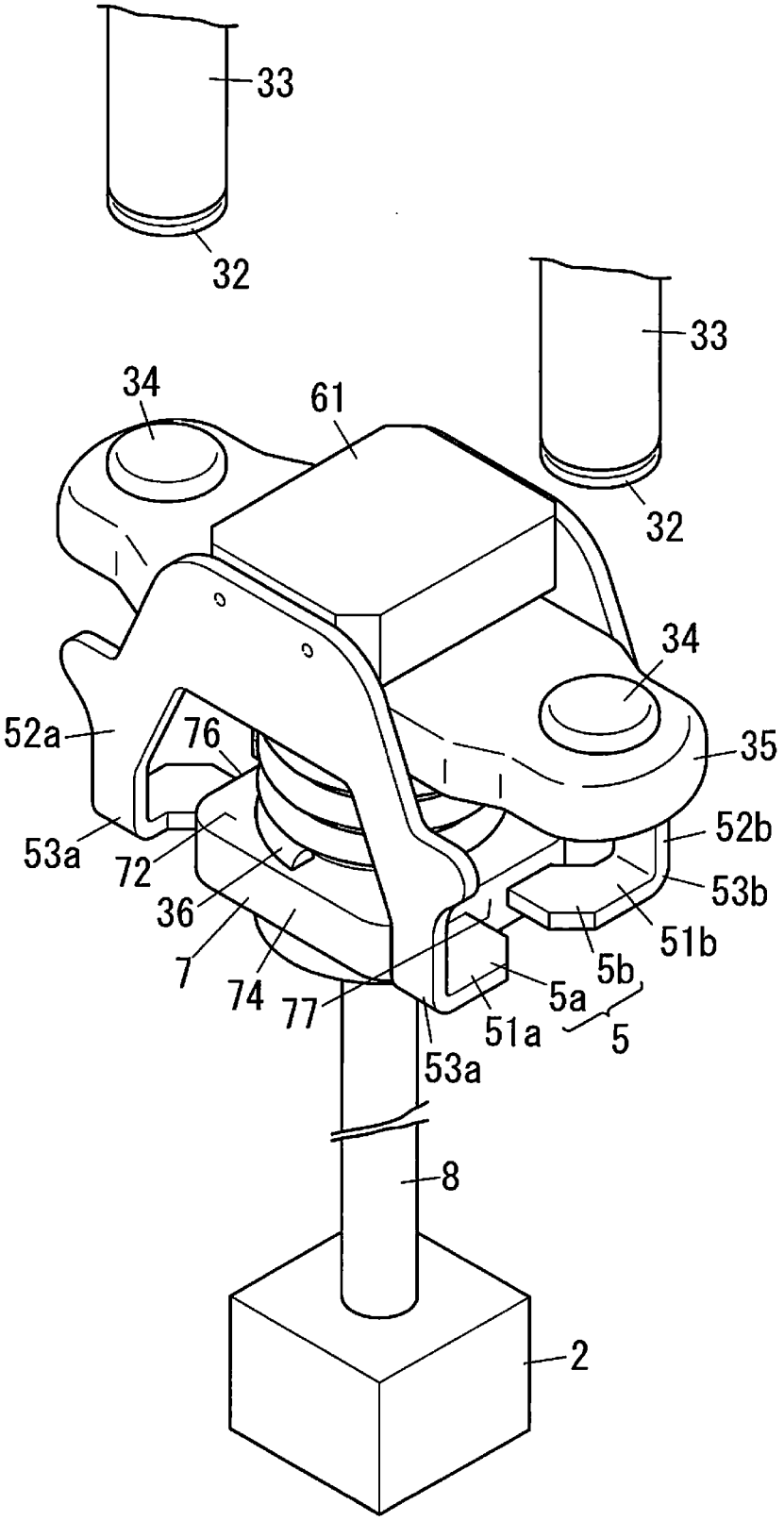
FIG. 1 is an external perspective view of a contact device according to an embodiment of the present invention.
Figure 2:
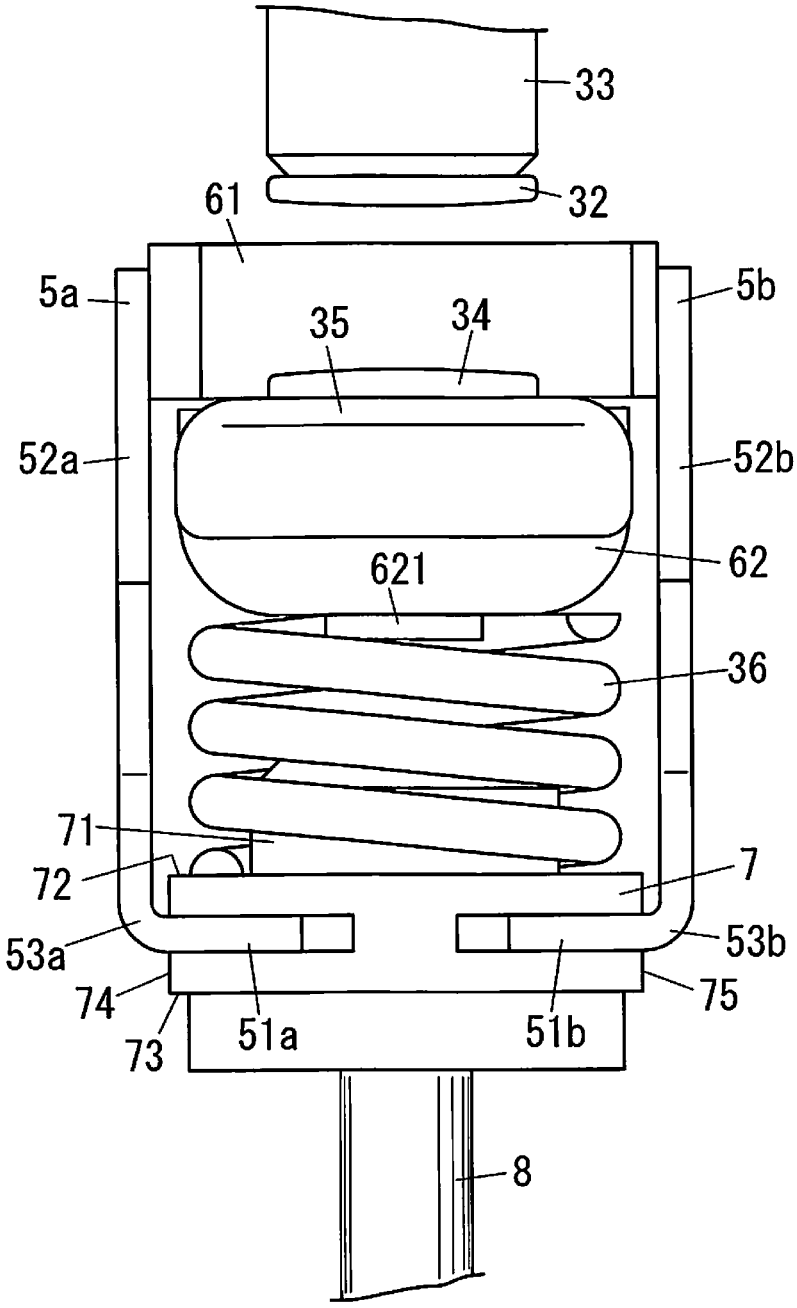
FIG. 2 is a side view of the contact device according to the embodiment of the present invention.

The contact device of the present embodiment includes, as shown in FIGS. 1 and 2, a pair of fixed terminals 33 respectively including fixed contacts 32, a movable contact maker 35 including a pair of movable contacts 34, a pressing spring 36, a holding portion 5, an adjustment plate 61, a yoke 62, and a spring receiving portion 7. Also, the contact device includes the movable shaft 8 and an electromagnet block (driving unit) 2.

Each of the fixed terminals 33 is formed in a substantially columnar shape of a conductive material such as copper, and the fixed contact 32 is fixed to a lower end (first end in the first direction) thereof. Note that the fixed contact 32 may be formed integrally with the fixed terminal 33.

Figure 3:
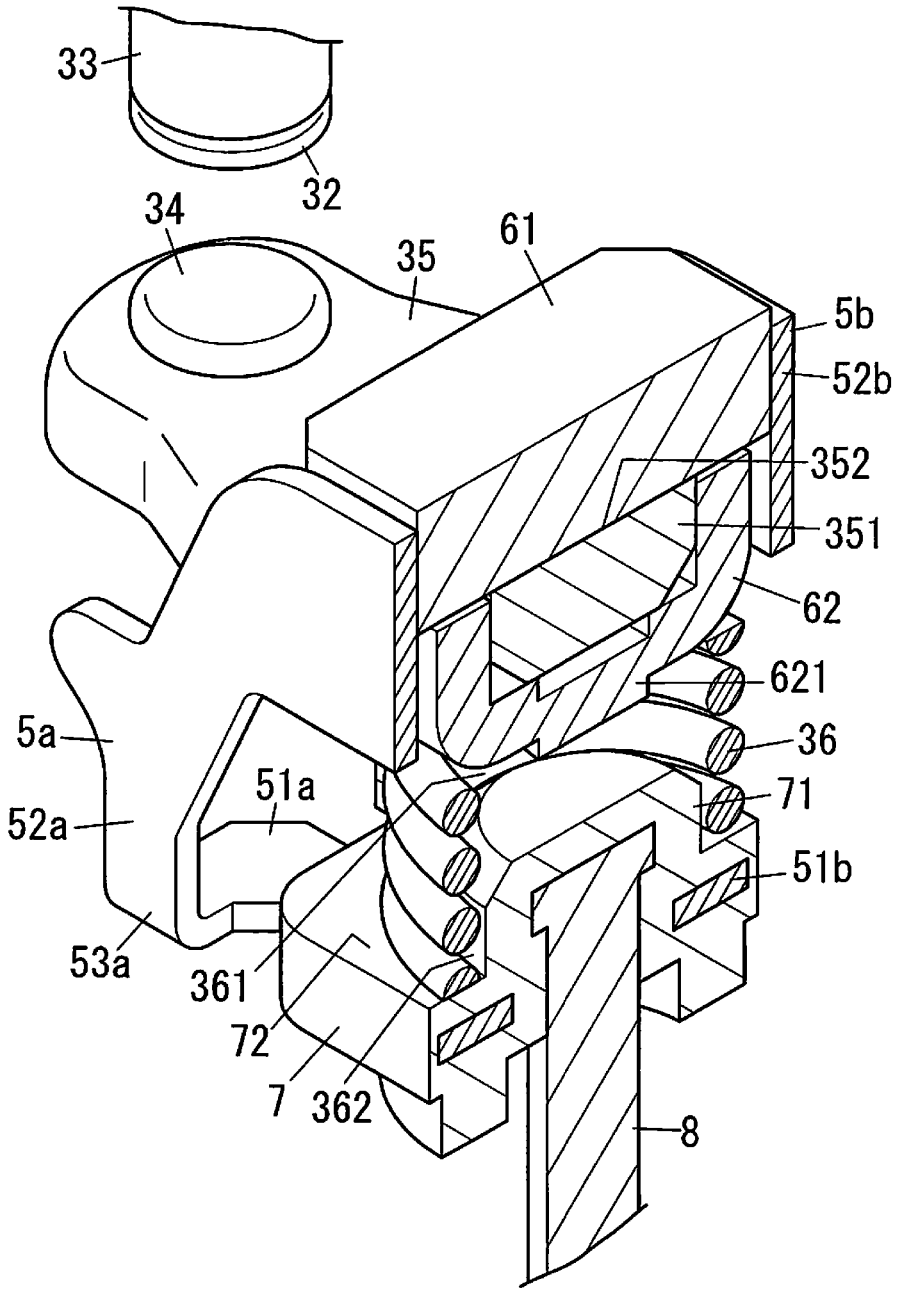
FIG. 3 is a cross-sectional perspective view of the contact device according to the embodiment of the present invention.
Figure 4:
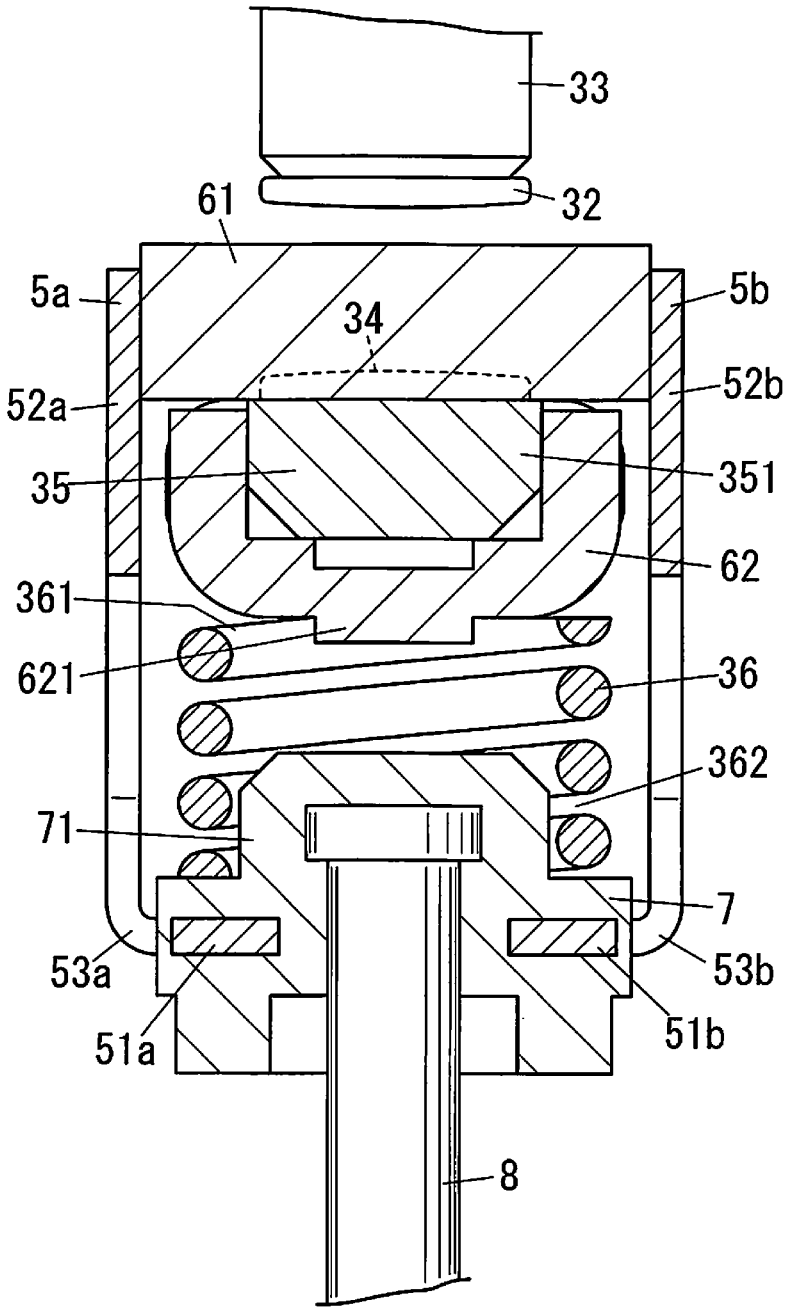
FIG. 4 is a cross-sectional side view of the contact device according to the embodiment of the present invention.

The movable contact maker 35 is formed in a flat plate-like shape elongated in the right and left direction, and the movable contacts 34 are respectively fixed on the right and left sides of the upper face thereof. Also, the movable contacts 34 are each arranged at a position opposing the corresponding fixed contact 32 with a predetermined space. Also, as shown in FIGS. 3 and 4, the movable contact maker 35 has a narrow width portion 351 with a narrow width in the front and rear direction at an approximately central portion in the right and left direction, and the yoke 62 is provided so as to be fitted to the narrow width portion 351.

The yoke 62 is made of a magnetic material, and is formed in a substantially U-like shape, in cross section, opening upward. Also, the yoke 62 is arranged on a lower side of the narrow width portion 351 so as to sandwich the narrow width portion 351 of the movable contact maker 35 in the front and rear direction. Also, a positioning protrusion 621 shaped substantially like a disk is formed at approximately the center of the lower face (one face in the first direction) of the yoke 62.

The pressing spring 36 is constituted by a coil spring, is arranged in a state in which an axial direction thereof is in the up and down direction, and is positioned relative to the yoke 62 and the movable contact maker 35 by the positioning protrusion 621 being fitted into an inner diameter portion (first inner diameter portion) 361 of an upper end side.

The spring receiving portion 7 is formed in a substantially rectangular plate-like shape of a material having an electrical insulation property such as resin, and a positioning protrusion 71 shaped substantially like a disk is formed at approximately the center of an upper face (first face in the first direction) 72 thereof. Also, the pressing spring 36 is positioned relative to the spring receiving portion 7 by the positioning protrusion 71 being fitted into an inner diameter portion (second inner diameter portion) 362 of a lower end side of the pressing spring 36.

The adjustment plate 61 is formed in a substantially rectangular plate-like shape of a magnetic material such as pure iron (SUY), or a cold rolled steel plate (SPCC (Steel Plate Cold Commercial) or SPCE (Steel Plate Cold deep drawn Extra)). Also, the adjustment plate 61 is mounted on an upper face (first face in the first direction) 352 of the movable contact maker 35 at an approximately central portion (narrow width portion 351) thereof in the right and left direction, and is fixed to the later-described holding portion 5.

The holding portion 5 includes a first holding portion 5*a* and a second holding portion 5*b*. The first holding portion 5*a* is formed of a non-magnetic material such as stainless steel (SUS (Steel Use Stainless)), and includes a first bottom plate 51*a* and a first side plate 52*a*. The second holding portion 5*b* is formed of a non-magnetic material such as stainless steel (SUS), and includes a second bottom plate 51*b* and a second side plate 52*b*. The first and second bottom plates 51*a* and 51*b* sandwich the movable contact maker 35, the yoke 62, and the pressing spring 36 with the adjustment plate 61 in the up and down direction. Accordingly, the movable contact maker 35 is pressed upward by the pressing spring 36, and movement toward the fixed contacts 32 is restricted by the upper face 352 coming into contact with the adjustment plate 61. The first and second side plates 52*a* and 52*b* respectively extend upward from a front end (first end in the third direction) of the first bottom plate 51*a* and a rear end (second end in the third direction) of the second bottom plate 51*b*, and oppose each other in the front and rear direction. The front end (first end in the third direction) and the rear end (second end in the third direction) of the movable contact maker 35 (yoke 62) are in sliding contact with the first and second side plates 52*a* and 52*b*, respectively. Also, the first and second side plates 52*a* and 52*b* sandwich the adjustment plate 61 in the front and rear direction by being respectively in contact with a front end (first end in the third direction) and the rear end (second end in the third direction) of the adjustment plate 61.

Figure 5:
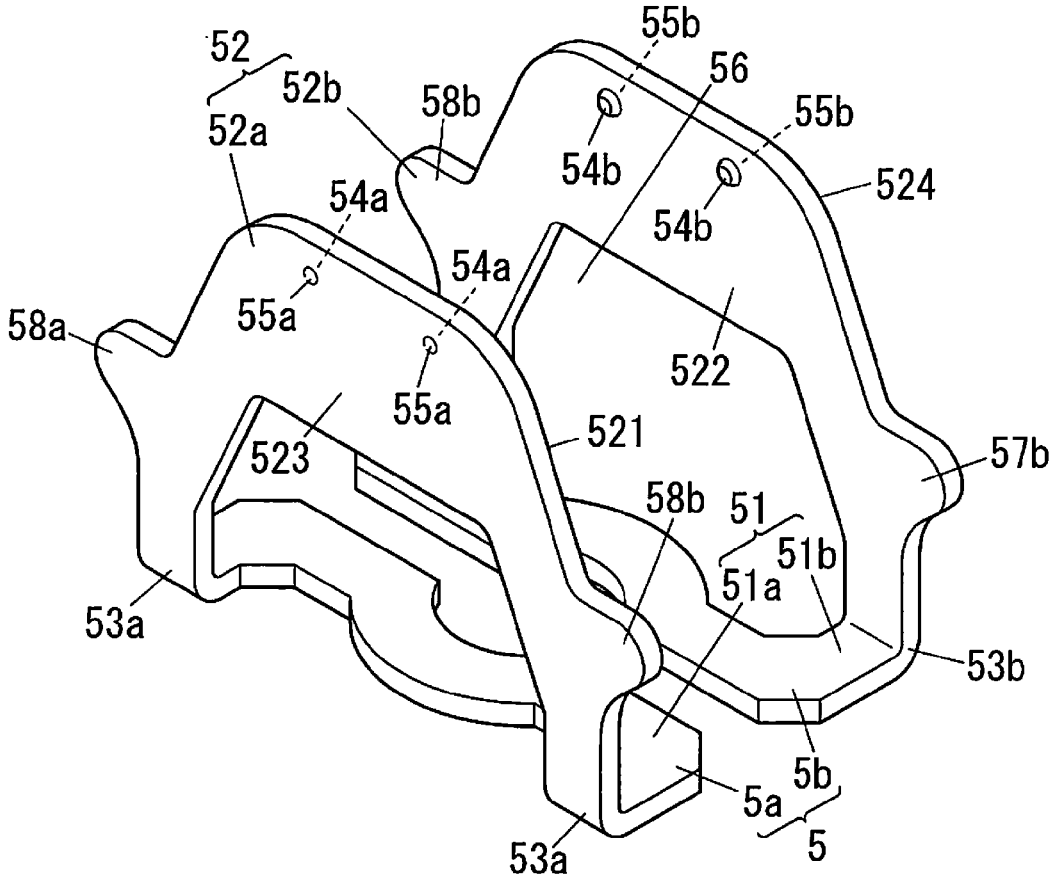
FIG. 5 is an external perspective view of a holding portion of the contact device according to the embodiment of the present invention.

Also, in the present embodiment, as shown in FIG. 5, the bottom plate 51 is divided in the front and rear direction, and is constituted by the first bottom plate 51*a* and the second bottom plate 51*b*. That is, the holding portion 5 is divided into the first holding portion 5*a* constituted by the first bottom plate 51*a* and the first side plate 52*a* extending from the front end of the first bottom plate 51*a*, and the second holding portion 5*b* constituted by the second bottom plate 51*b* and the second side plate 52*b* extending from the rear end of the second bottom plate 51*b*.

In the first and second holding portions 5*a* and 5*b*, the first bottom plate 51*a* and the first side plate 52*a*, and the second bottom plate 51*b* and the second side plate 52*b* are each formed by subjecting a non-magnetic material having a plate frame-like shape to bending process. Therefore, the first bottom plate 51*a* and the first side plate 52*a* are continuous via a first bent portion 53*a*, and the second bottom plate 51*b* and the second side plate 52*b* are continuous via a second bent portion 53*b*. Also, as shown in FIGS. 3 and 4, the first and second holding portions 5*a* and 5*b* are formed integrally with the spring receiving portion 7 in a state of being separated from each other in the front and rear direction, and the spring receiving portion 7 is interposed between the bottom plate 51 (first and second bottom plates 51*a* and 51*b*) and the pressing spring 36. That is, the spring receiving portion 7 is provided on the bottom plate 51 (first and second bottom plates 51*a* and 51*b*), and electrically insulates the bottom plate 51 from the pressing spring 36.

As described above, the holding portion 5 of the present embodiment is divided in the front and rear direction and constituted by the first and second holding portions 5*a* and 5*b*, and the first and second holding portions 5*a* and 5*b* are integrally formed, in a state of being separated from each other, with the spring receiving portion 7 having an insulation property. Also, due to the adjustment plate 61 being sandwiched between the first and second side plates 52*a* and 52*b*, the first and second holding portions 5*a* and 5*b* are electrically connected via only the adjustment plate 61.

The movable shaft 8 is formed in a substantially bar-like shape elongated in the up and down direction, and the electromagnet block 2 is connected to a lower end 83 thereof. The movable shaft 8 is coupled to the holding portion 5 due to an upper end 82 thereof being integrally formed with the spring receiving portion 7.

The electromagnet block 2 drives the movable shaft 8 in the up and down direction such that the movable contacts 34 are brought into contact with and separated from the respective fixed contacts 32.

Next, a method of adjusting the pressing force (hereinafter referred to as initial pressing force) of the pressing spring 36 against the movable contact maker 35 in an open state in which the movable contacts 34 are separated from the fixed contacts 32 will be described. In the contact device of the present embodiment, the initial pressing force can be adjusted easily by adjusting a position of the adjustment plate 61 in the up and down direction, when the adjustment plate 61 is inserted between the first and second side plates 52*a* and 52*b*.

If the adjustment plate 61 is pressed downward, the adjustment plate 61, the movable contact maker 35, and the yoke 62 move downward against the biasing force of the pressing spring 36, and pressing force of the pressing spring 36 against the yoke 62 (movable contact maker 35) is generated. Also, the initial pressing force can be increased more when the adjustment plate 61 is moved further downward, and the initial pressing force can be reduced when the adjustment plate 61 is moved upward. Also, the front and rear ends (two ends in the third direction) of the adjustment plate 61 are respectively fixed to the first and second side plates 52*a* and 52*b* at a position at which the initial pressing force is a predetermined value.

Here, in the present embodiment, as described above, the first and second holding portions 5*a* and 5*b* are integrally formed, in a state of being separated from each other in the front and rear direction, with the spring receiving portion 7 having an insulation property, and are thereby electrically connected each other via only the adjustment plate 61. Accordingly, the adjustment plate 61 and the first and second holding portions 5*a* and 5*b* can be subjected to resistance welding, by bringing electrodes into contact with the first and second side plates 52*a* and 52*b*, respectively, and applying an electric current between the first and second side plates 52*a* and 52*b* via only the adjustment plate 61. The adjustment plate 61 and the holding portion 5 (first and second holding portions 5*a* and 5*b*) can thereby be easily fixed in a short time compared with the conventional contact device, and as a result ease of assembly can be improved.

Also, the holding portion 5 includes an opening portion 56 on an upward side, to which the bottom plate 51 opposes, and the pressing spring 36, the yoke 62, and the movable contact maker 35 can be housed easily inside the holding portion 5 through the opening portion 56. Then, the adjustment plate 61 is inserted from above between the first and second side plates 52*a* and 52*b* and is fixed so as to cover the opening portion 56 of the holding portion 5, and assembly of parts to the holding portion 5 can thereby be made easy and ease of assembly can be improved.

Also, in the holding portion 5 of the present embodiment, as shown in FIG. 5, out of the rear face (first face) 521 of the first side plate 52*a* and the front face (second face) 522 of the second side plate 52*b* that oppose each other in the front and rear direction, two first protrusions 54*a* are formed on the rear face (first face in the third direction) 521 of the first side plate 52*a*, and two second protrusions 54*b* are formed on the front face (second face in the third direction) 522 of the second side plate 52*b*. Then, when the adjustment plate 61 is inserted so as to cover the opening portion 56 of the holding portion 5, the first protrusions 54*a* come into contact with the front face (first face in the third direction) of the adjustment plate 61, and the second protrusions 54*b* come into contact with the rear face (second face of the third direction) of the adjustment plate 61. As a result, the adjustment plate 61 and the holding portion 5 (first and second holding portions 5*a* and 5*b*) can be subjected to projection welding. The adjustment plate 61 and the holding portion 5 (first and second holding portions 5*a* and 5*b*) can thereby be fixed in a shorter time. Also, since two first protrusions 54*a* are formed in the first side plate 52*a*, the welding area between the adjustment plate 61 and the first holding portion 5*a* increases, and the welding state can be stabilized. Since the two second protrusions 54*b* are formed on the second side plate 52*b*, the welding area between the adjustment plate 61 and the second holding portion 5*b* increases, and the welding state can be stabilized. Note that the number of first protrusions 54*a* is not limited to two, and more first protrusions 54*a* may be formed. The number of second protrusions 54*b* is not limited to two, and more second protrusions 54*b* may be formed.

Also, the protrusions 54*a* and 54*b* are respectively formed on the rear face of the first side plate 52*a* and the front face of the second side plate 52*b* by extrusion from the front face side of the first side plate 52*a* and the rear face side of the second side plate 52*b*, respectively, and the protrusions 54*a* and 54*b* can be easily formed. That is, the first protrusions 54*a* are formed on the rear face 521 of the first side plate 52*a* by extrusion from a side of the front face (third face in the third direction) 523 of the first side plate 52*a*, and the first protrusions 54*a* can be easily formed. The second protrusions 54*b* are formed on the front face 522 of the second side plate 52*b* by extrusion from a side of the rear face (fourth face in the third direction) 524 of the second side plate 52*b*, and the second protrusions 54*b* can be easily formed. Furthermore, since the first and second protrusions 54*a* and 54*b* that are formed respectively on the first and second side plates 52*a* and 52*b* are formed on the same plane (the rear face 521 of the first side plate 52*a* and the front face 522 of the second side plate 52*b*), the height of the protrusions 54*a* and 54*b* is easily controlled. Accordingly, when projection welding is performed, contact failures between the protrusions 54*a* and 54*b* and the adjustment plate 61 can be reduced, and the welding between the adjustment plate 61 and the first and second holding portions 5*a* and 5*b* can be stabilized. Also, the front face 523 of the first side plate 52*a* and the rear face 524 of the second side plate 52*b*, with which electrodes are brought into contact when the projection welding is performed, are formed in a planar shape (except for recessions 55*a* and 55*b* that are formed when the protrusions 54*a* and 54*b* are formed by extrusion). The electrodes can thereby be easily brought into contact with the first and second side plates 52*a* and 52*b*, the welding can be stabilized, and the shape after welding can be stabilized.

Also, the first holding portion 5*a* includes first projecting portions 57*a* and 58*a*. The first projecting portions 57*a* and 58*a* are provided integrally with the first side plate 52*a* at the respective ends of the first side plate 52*a* in the right and left direction (first direction). The second holding portion 5*b* includes second projecting portions 57*b* and 58*b*. The second projecting portions 57*b* and 58*b* are provided integrally with the second side plate 52*b* at the respective ends of the second side plate 52*b* in the right and left direction (first direction). Due to the first projecting portions 57*a* and 58*a* and the second projecting portions 57*b* and 58*b* coming into contact with the inner wall of a case 31, rotation of the movable contact maker 35 can be inhibited.

Also, in the present embodiment, the bottom plate 51 (first and second bottom plates 51*a* and 51*b*) of the holding portion 5 is provided with the spring receiving portion 7, and first and second bent portions 53*a* and 53*b* that respectively connect the respective first and second bottom plates 51*a* and 51*b* with the respective first and second side plates 52*a* and 52*b* are exposed from the spring receiving portion 7. Accordingly, after the holding portion 5 and the spring receiving portion 7 are formed integrally, the first and second bent portions 53*a* and 53*b* can be formed by bending processing, and as a result the first and second bottom plates 51*a* and 51*b* and the first and second side plates 52*a* and 52*b* can be formed easily.

Also, the spring receiving portion 7 of the present embodiment is formed in a rectangular plate-like shape having a predetermined thickness in the up and down direction, and side faces thereof (front face (third face in the third direction) 74, rear face (fourth face in the third direction) 75, left face (fifth face in the second direction) 76, and right face (sixth face in the second direction) 77) are each formed in a planar shape. Therefore, when the contact device is assembled, the side faces of the spring receiving portion 7 that are opposing to each other (front face 74 and rear face 75, or left face 76 and right face 77) can be chucked, and ease of assembly can be improved. Note that a configuration may be adopted in which the upper face (first face in the first direction) 72 and the lower face (second face in the first direction) 73 of the spring receiving portion 7 are chucked.

Also, the surface of the adjustment plate 61 of the present embodiment is coated by plating with a thickness of 20 μm or less, for example. The welding between the adjustment plate 61 and the first and second holding portions 5*a* and 5*b* can thereby be stabilized.

Also, in the present embodiment, the adjustment plate 61 that is arranged above the movable contact maker 35 and the yoke 62 that is arranged below the movable contact maker 35 are made of a magnetic material, and the holding portion 5 (first and second holding portions 5*a* and 5*b*) is made of a non-magnetic material. Accordingly, when the movable contacts 34 are brought into contact with the respective fixed contacts 32, and an electric current flows through the movable contact maker 35, magnetic flux that passes through the adjustment plate 61 and the yoke 62 is formed around the movable contact maker 35, the movable contact maker 35 being the center. Also, magnetic attractive force works between the adjustment plate 61 and the yoke 62, and electromagnetic repulsive force between the fixed contacts 32 and the movable contacts 34 is counteracted by the magnetic attractive force, and as a result the pressing force between the fixed contacts 32 and the movable contacts 34 can be suppressed from decreasing.

Note that, in the present embodiment, the holding portion 5 and the spring receiving portion 7 are formed integrally, and the spring receiving portion 7 is interposed between the bottom plate 51 (the first and second bottom plates 51*a* and 51*b*) and the pressing spring 36. The bottom plate 51 and the pressing spring 36 are thereby insulated, and the first and second holding portions 5*a* and 5*b* are configured to be electrically connected via only the adjustment plate 61. However, the configuration is not limited to this, and a configuration may be adopted in which the spring receiving portion 7 is omitted, and the pressing spring 36 is directly provided on the first and second bottom plates 51*a* and 51*b*. In this case, at least one of the pressing spring 36 and the pair of first and second bottom plates 51*a* and 51*b* is formed of a material having an electrical insulation property. Accordingly, the first and second holding portions 5*a* and 5*b* can be configured so as to be electrically connected via only the adjustment plate 61, while being not electrically connected via the pressing spring 36, and as a result the first and second holding portions 5*a* and 5*b* and the adjustment plate 61 can be subjected to resistance welding.

As described above, in the contact device of the present embodiment, a spring load (initial pressing force) adjustment structure and a spring load (initial pressing force) adjustment method are configured by the holding portion 5 and the adjustment plate 61. Also, since the first and second holding portions 5*a* and 5*b* are electrically connected via only the adjustment plate 61, the adjustment plate 61 and the first and second holding portions 5*a* and 5*b* can be welded easily, and the initial pressing force in an open state can be easily adjusted. Also, by performing adjustment of the initial pressing force in each of the contact devices, variability of the initial pressing force in a plurality of contact devices can be reduced, and as a result upsizing of the electromagnet block 2 is not required and the contact device can be prevented from increasing in size.

Next, operations of the contact device of the present embodiment configured as described above will be described. First, when the movable shaft 8 is displaced upward by the electromagnet block (driving unit) 2, the spring receiving portion 7 and the holding portion 5 that are connected to the movable shaft 8 are accordingly displaced upward as well. Then, the movable contact maker 35 is moved upward as well due to the displacement, and the movable contacts 34 come into contact with the respective fixed contacts 32, so that the contacts are brought into conduction. At this time, since the pressing force of the pressing spring 36 against the movable contact maker 35 is adjusted as described above, the pressing force that works between the movable contacts 34 and the fixed contacts 32 in each of a plurality of the contact devices can be made substantially equal to each other. Accordingly, upsizing of the electromagnet block 2 is not required and the contact device can be prevented from increasing in size.

Also, since the adjustment plate 61 is housed between the first and second side plates 52*a* and 52*b*, a space for housing the adjustment plate 61 is not required to be provided separately, and as a result the contact device can be prevented from increasing in size.

Also, in the spring load adjustment structure and the spring load adjustment method in the present embodiment, the initial pressing force can be adjusted by changing the position of the adjustment plate 61 in the up and down direction, and the initial pressing force after adjustment is maintained by fixing the adjustment plate 61 to the first and second side plates 52*a* and 52*b* after adjustment. Accordingly, since separate members are not required to adjust the initial pressing force and to maintain the initial pressing force after adjustment, manufacturing cost can be prevented from increasing.

Figure 6B:
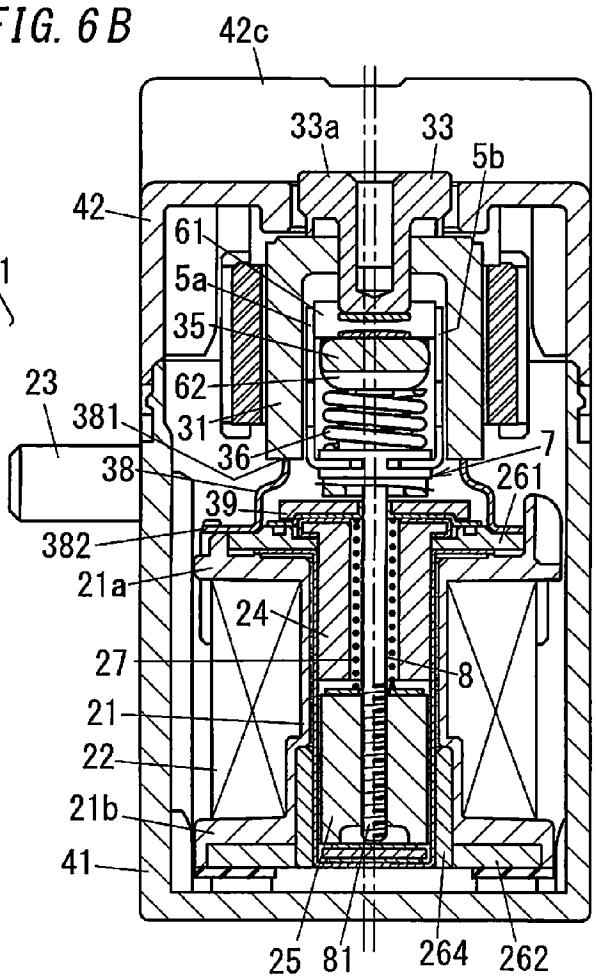
FIG. 6B is another cross-sectional view of the electromagnetic relay including the contact device according to the embodiment of the present invention.
Figure 6A:
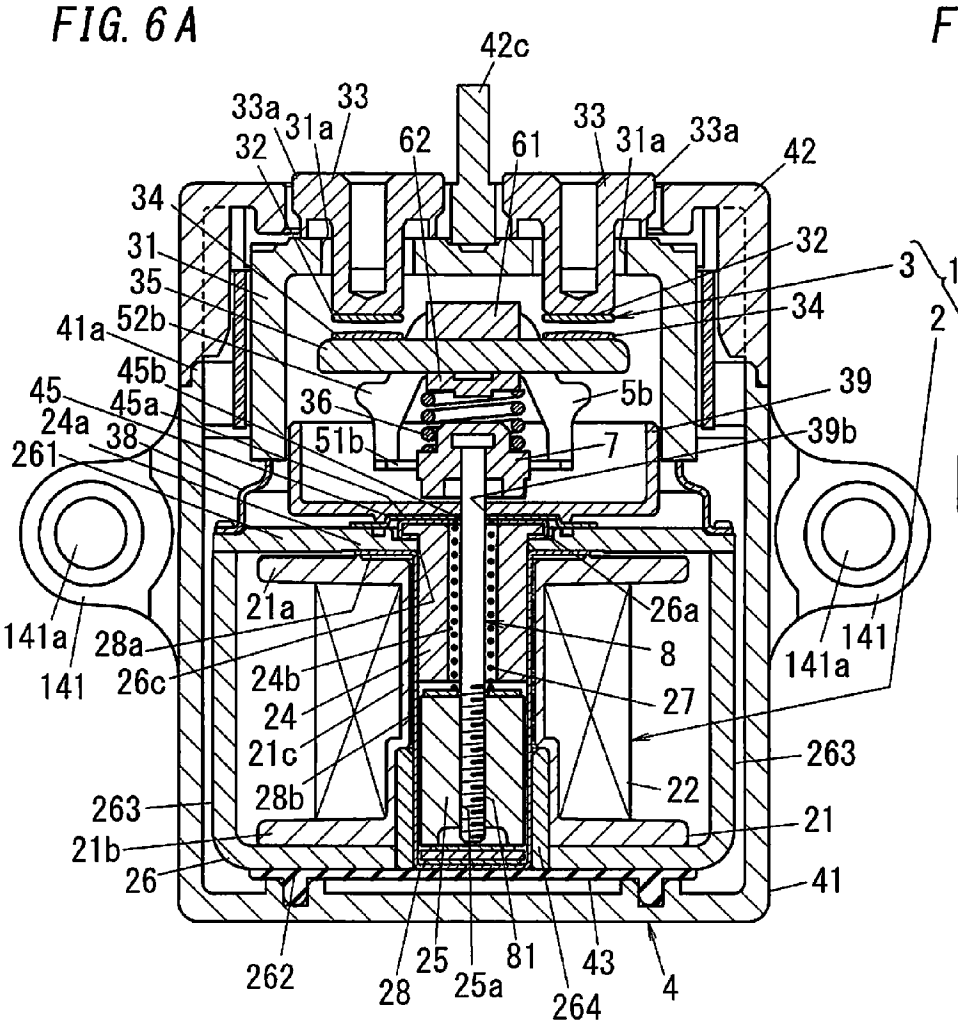
FIG. 6A is a cross-sectional view of an electromagnetic relay including the contact device according to the embodiment of the present invention.
Figure 7B:
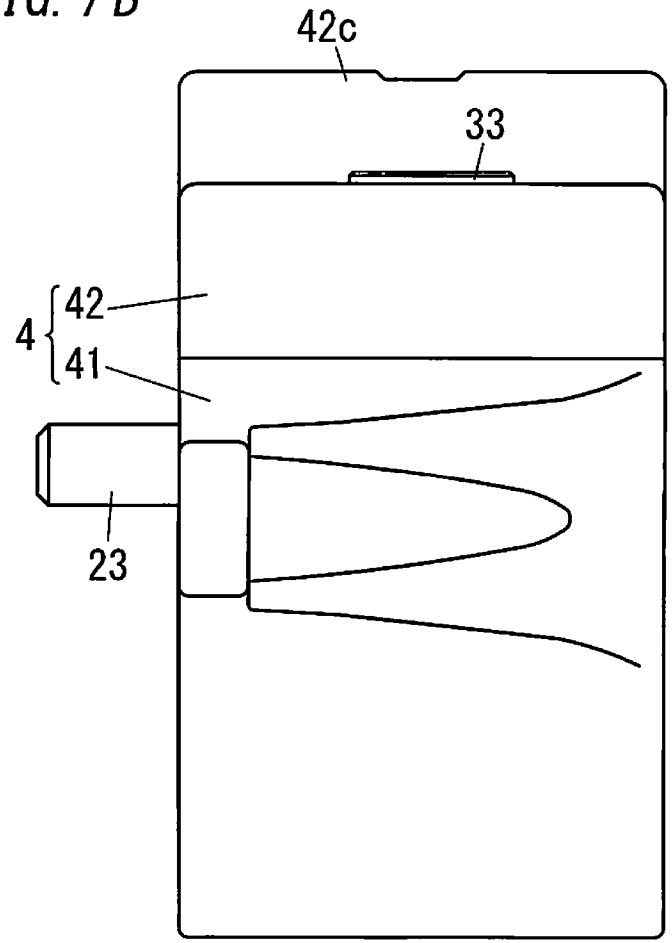
FIG. 7B is another external view of the electromagnetic relay including the contact device according to the embodiment of the present invention.
Figure 7A:
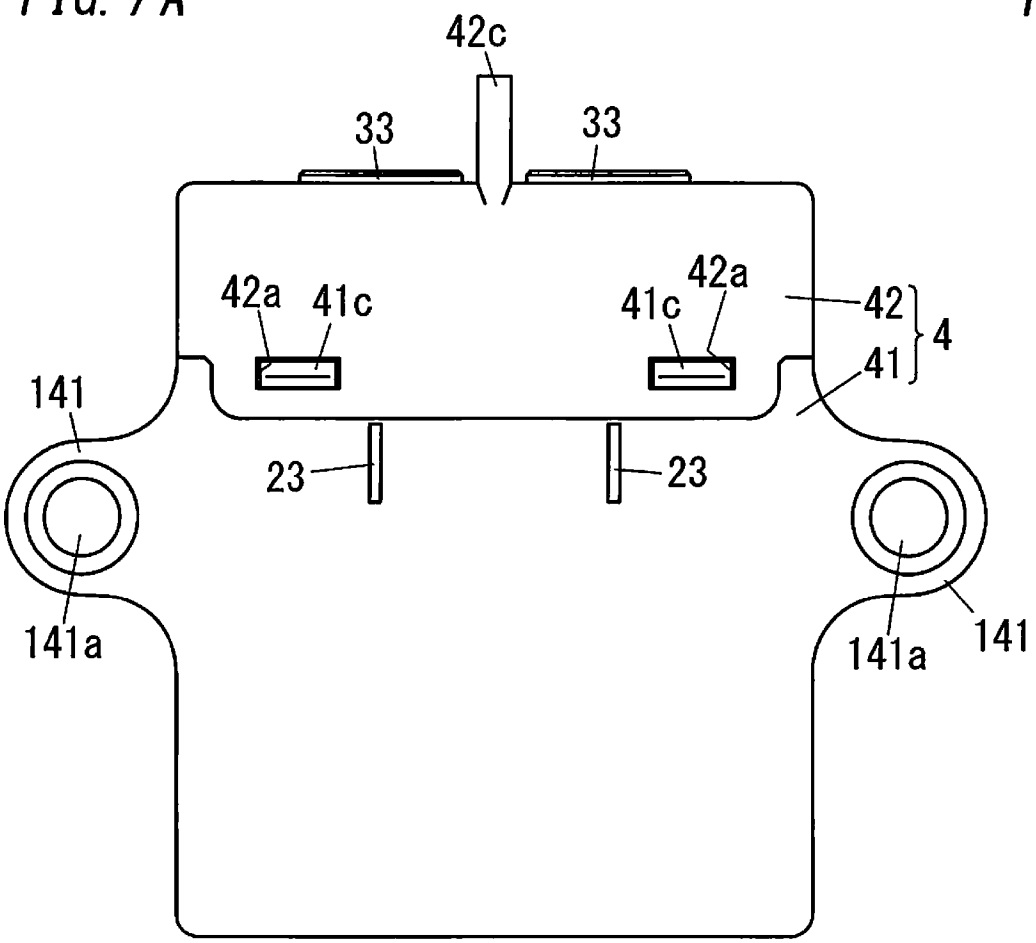
FIG. 7A is an external view of the electromagnetic relay including the contact device according to the embodiment of the present invention.

Also, the contact device of the present embodiment described above is used in an electromagnetic relay, as shown in FIGS. 6A and 6B, for example.

In the electromagnetic relay, as shown in FIGS. 6A, 6B, 7A, 7B, and 8A to 8C, an inner unit block 1 configured by integrally combining the electromagnet block (driving unit) 2 and a contact block 3 is housed in a housing 4 having a hollow box shape. Hereinafter, up, down, right, and left directions in FIG. 6A are used as references, and a direction orthogonal to the up and down, and right and left directions is defined as a front and rear direction.

The electromagnet block 2 includes a coil bobbin 21 around which an excitation winding 22 is wound, a pair of coil terminals 23 to which two ends of the excitation winding 22 are respectively connected, a stationary core 24 that is arranged and fixed in the coil bobbin 21, a movable core 25, a yoke 26, and a return spring 27.

The coil bobbin 21 is formed of a resin material in a substantially cylindrical shape having flange portions 21*a* and 21*b* formed at an upper end (first end in the first direction) and a lower end (second end in the first direction) thereof, and the excitation winding 22 is wound around a cylinder portion 21*c* between the flange portions 21*a* and 21*b*. Also, an inner diameter of the cylinder portion 21*c* at a lower end (second end in the first direction) side is larger than an inner diameter at an upper end (first end in the first direction) side.

Figure 8A:
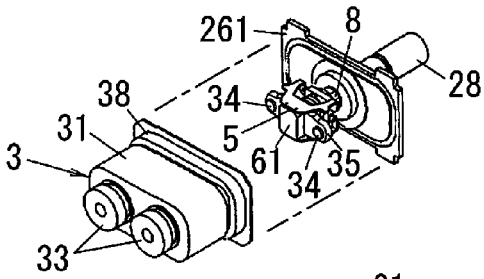
FIG. 8A is an exploded perspective view of the electromagnetic relay including the contact device according to the embodiment of the present invention.
Figure 8B:
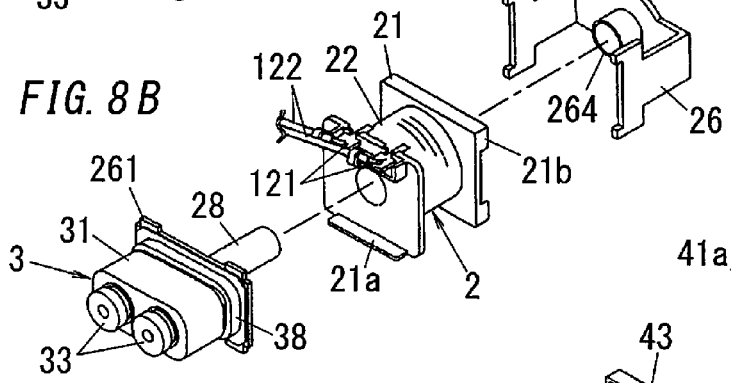
FIG. 8B is another exploded perspective view of the electromagnetic relay including the contact device according to the embodiment of the present invention.
Figure 8C:
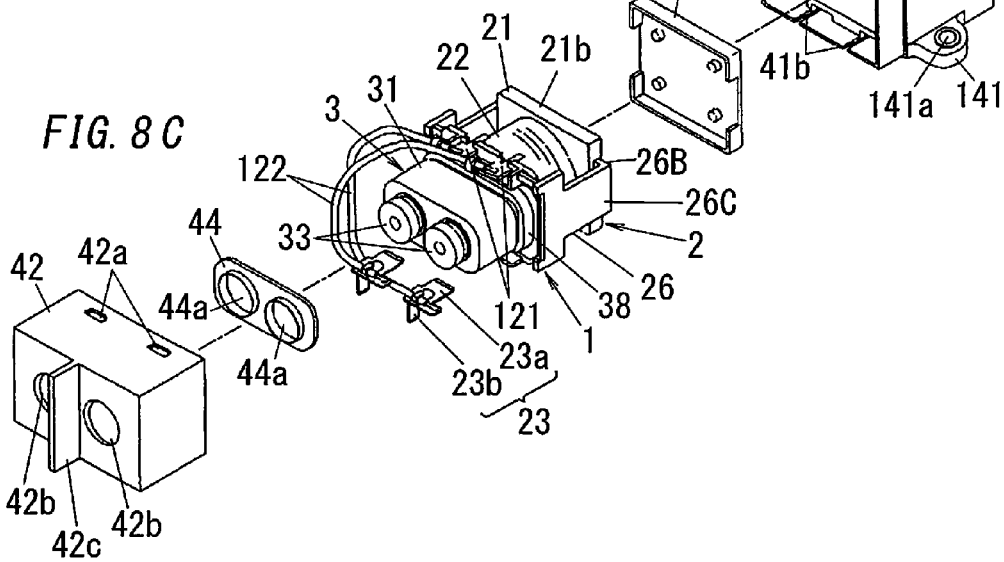
FIG. 8C is yet another exploded perspective view of the electromagnetic relay including the contact device according to the embodiment of the present invention.

End portions of the excitation winding 22, as shown in FIG. 8C, are connected respectively to a pair of terminal portions 121 being provided on the flange portion 21*a* (refer to FIG. 8B) of the coil bobbin 21, and are respectively connected to the pair of coil terminals 23 via lead wires 122, each of which is connected to the terminal portion 121.

The coil terminals 23 are formed of a conductive material such as copper, and are connected to the respective lead wires 122 by solder, or the like.

The yoke 26 includes, as shown in FIG. 6A, a yoke plate 261 arranged on an upper end side of the coil bobbin 21, a yoke plate 262 arranged on a lower end side of the coil bobbin 21, and a pair of yoke plates 263 that respectively extend toward the yoke plate 261 from the right and left ends (two ends in the second direction) of the yoke plate 262.

The yoke plate 261 is formed in a substantially rectangular plate-like shape, a recession 26*a* is formed at approximately the center thereof on an upper face side, and an insertion hole 26*c* is formed at approximately the center of the recession 26*a*.

Also, a cylinder member 28 in a bottomed cylindrical shape having a flange portion 28*a* formed at an upper end (first end in the first direction) thereof is inserted in the insertion hole 26*c*, and the flange portion 28*a* is positioned between the yoke plate 261 and the flange portion 21*a*. Here, the movable core 25 that is formed in a substantially columnar shape of a magnetic material is arranged on a lower end (second end in the first direction) side in a cylinder portion 28*b* of the cylinder member 28. Furthermore, in the cylinder portion 28*b*, the stationary core 24 that is formed in a substantially cylindrical shape of a magnetic material is arranged so as to oppose the movable core 25 in an axial direction.

Also, a cap member 45 in a substantially disk-like shape, a peripheral edge portion thereof being fixed to an opening peripheral edge of the insertion hole 26*c* of the yoke plate 261, is provided on an upper face of the yoke plate 261, and the cap member 45 prevents the stationary core 24 from slipping-off. Also, a portion at approximately a center of the cap member 45 is recessed upward in a substantially columnar shape so as to form a recession 45*a*, and a flange portion 24*a* that is formed at an upper end (first end of the first direction) of the stationary core 24 is housed inside the recession 45*a*.

Also, a bush 264 formed of a magnetic material in a cylindrical shape is fitted into a space formed between the inner circumferential face of the coil bobbin 21 on a lower end side and the outer circumferential face of the cylinder member 28. Also, the bush 264 forms a magnetic circuit together with the yoke plates 261 to 263, the stationary core 24, and the movable core 25.

The return spring 27 passes through a throughhole (inner diameter) 24*b* of the stationary core 24, a lower end (second end in the first direction) thereof comes into contact with an upper face (one face in the first direction) of the movable core 25, and an upper end (first end in the first direction) thereof comes into contact with a lower face (one face in the first direction) of the cap member 45. Here, the return spring 27 is provided between the movable core 25 and the cap member 45 in a compressed state, and elastically biases the movable core 25 downward.

Next, the contact block 3 includes the case 31, the pair of fixed terminals 33, the movable contact maker 35, the pressing spring 36, the holding portion 5, the adjustment plate 61, the yoke 62, the spring receiving portion 7, and the movable shaft 8.

The movable shaft 8 is formed in a substantially round bar-like shape elongated in the up and down direction, and a thread groove is formed on a side of the lower end 83 such that a thread portion 81 is formed. Also, the side of the lower end 83 of the movable shaft 8 passes through a insertion hole 45*b* formed at approximately the center of the recession 45*a* of the cap member 45 and through the return spring 27, and the thread portion 81 is screwed to a thread hole 25*a* that is formed in the movable core 25 along the axial direction. Accordingly, the movable shaft 8 and the movable core 25 are connected. Also, the upper end 82 of the movable shaft 8 is connected to the spring receiving portion 7.

The case 31 is formed of a heat-resistant material such as ceramic in the shape of a hollow box whose lower face is opened, and two throughholes 31*a* are provided side by side on an upper face of the case 31.

Each of the fixed terminals 33 is formed of a conductive material such as copper in a substantially columnar shape, a flange portion 33*a* is formed at an upper end (second end in the first direction), and the fixed contact 32 is provided on a lower end (first end in the first direction). The fixed terminals 33 are inserted into the respective throughholes 31*a* of the case 31, and are joined to the case 31 by brazing in a state in which the flange portions 33*a* protrude from the upper face of the case 31.

Also, as shown in FIG. 6A, one end (first end in the first direction) 381 of a coupling body 38 is joined to an opening peripheral edge of the case 31 by brazing. Also, the other end (second end in the first direction) 382 of the coupling body 38 is joined to the yoke plate 261 by brazing.

Furthermore, an insulation member 39 is provided at the opening portion of the case 31 in order to insulate an arc generated between the fixed contacts 32 and the movable contacts 34 from a joint portion between the case 31 and the coupling body 38.

The insulation member 39 is formed of an insulation material such as ceramic or a synthetic resin in a substantially hollow rectangular parallelepiped-like shape in which an upper face is opened, and an upper end (one end in the first direction) side of a peripheral wall comes into contact with an inner face of the peripheral wall of the case 31. Accordingly, the contact portion constituted by the fixed contacts 32 and the movable contacts 34 is insulated from the joint portion between the case 31 and the coupling body 38.

Furthermore, an insertion hole 39*b* into which the movable shaft 8 is inserted is formed at approximately a center of an inner bottom face of the insulation member 39.

The housing 4 is formed of a resin material in a substantially rectangular box-like shape, and includes a housing body 41 in a hollow box shape in which an upper face is opened, and a cover 42 in a hollow box shape that covers the opening of the housing body 41.

The housing body 41 is provided with projection portions 141, in each of which an insertion hole 141*a* that is used when the electromagnetic relay is fixed to a mounting face by screwing is formed, at respective front ends of the right and left side walls. Also, a step 41*a* is formed at the opening peripheral edge of the housing body 41 on an upper end (first end in the first direction) side, and the size of an outer periphery on an upper end side is smaller than that on a lower end (second end in the first direction) side. Also, a pair of slits 41*b*, to which respective terminal portions 23*b* of the coil terminals 23 are fitted, is formed in the step 41*a*. Furthermore, a pair of projections 41*c* is provided on the step 41*a* side by side in the right and left direction.

The cover 42 is formed in a shape of a hollow box having an opened lower face, and a pair of holes 42*a*, to which the projections 41*c* of the housing body 41 are respectively fitted when the cover 42 is mounted to the housing body 41, is formed. Also, a partition 42*c* for dividing an upper face of the cover 42 into right and left parts, the sizes thereof being approximately the same, is formed on the upper face of the cover 42. Insertion holes 42*b*, into which the fixed terminals 33 are respectively inserted, are formed on the respective parts of the upper face divided by the partition 42*c*.

Also, as shown in FIG. 8C, when the inner unit block 1 constituted by the electromagnet block 2 and the contact block 3 is housed in the housing 4, a lower side cushion rubber 43 having a substantially rectangular shape is interposed between the flange portion 21*b* at a lower end of the coil bobbin 21 and a bottom face of the housing body 41. Then, an upper side cushion rubber 44 having insertion holes 44*a*, to which the flange portions 33*a* of the fixed terminals 33 are respectively inserted, is interposed between the case 31 and the cover 42.

In the electromagnetic relay having the above configuration, the movable core 25 slides downward due to the biasing force of the return spring 27, and the movable shaft 8 moves downward as well in association therewith. The movable contact maker 35 being pressed downward by the adjustment plate 61 thereby moves downward along with the adjustment plate 61. Accordingly, the movable contacts 34 are separated from the fixed contacts 32 in the initial state.

Then, when an electric current is applied to the excitation winding 22, and the movable core 25 slides upward due to being attracted by the stationary core 24, the movable shaft 8 that is coupled to the movable core 25 moves upward as well in conjunction with the sliding. Accordingly, the spring receiving portion 7 (holding portion 5) that is connected to the movable shaft 8 moves toward the fixed contacts 32, and the movable contact maker 35 moves upward as well in accordance with the movement. Then, the movable contacts 34 come into contact with the respective fixed contacts 32, so that the contacts are brought into conduction.

Also, when an electric current to the excitation winding 22 is turned off, the movable core 25 slides downward due to the biasing force of the return spring 27, and the movable shaft 8 moves downward as well in accordance with the sliding. Accordingly, since the spring receiving portion 7 (holding portion 5) moves downward as well, and the movable contact maker 35 moves downward as well in accordance with the movement, the movable contacts 34 are separated from the fixed contacts 32.

Since the above electromagnetic relay includes the contact device of the present embodiment, the initial pressing force can be adjusted easily. Also, since variability of the initial pressing force in among contact devices can be reduced, upsizing of the electromagnet block 2 is not required and the electromagnetic relay can be prevented from increasing in size.

Figure 9:
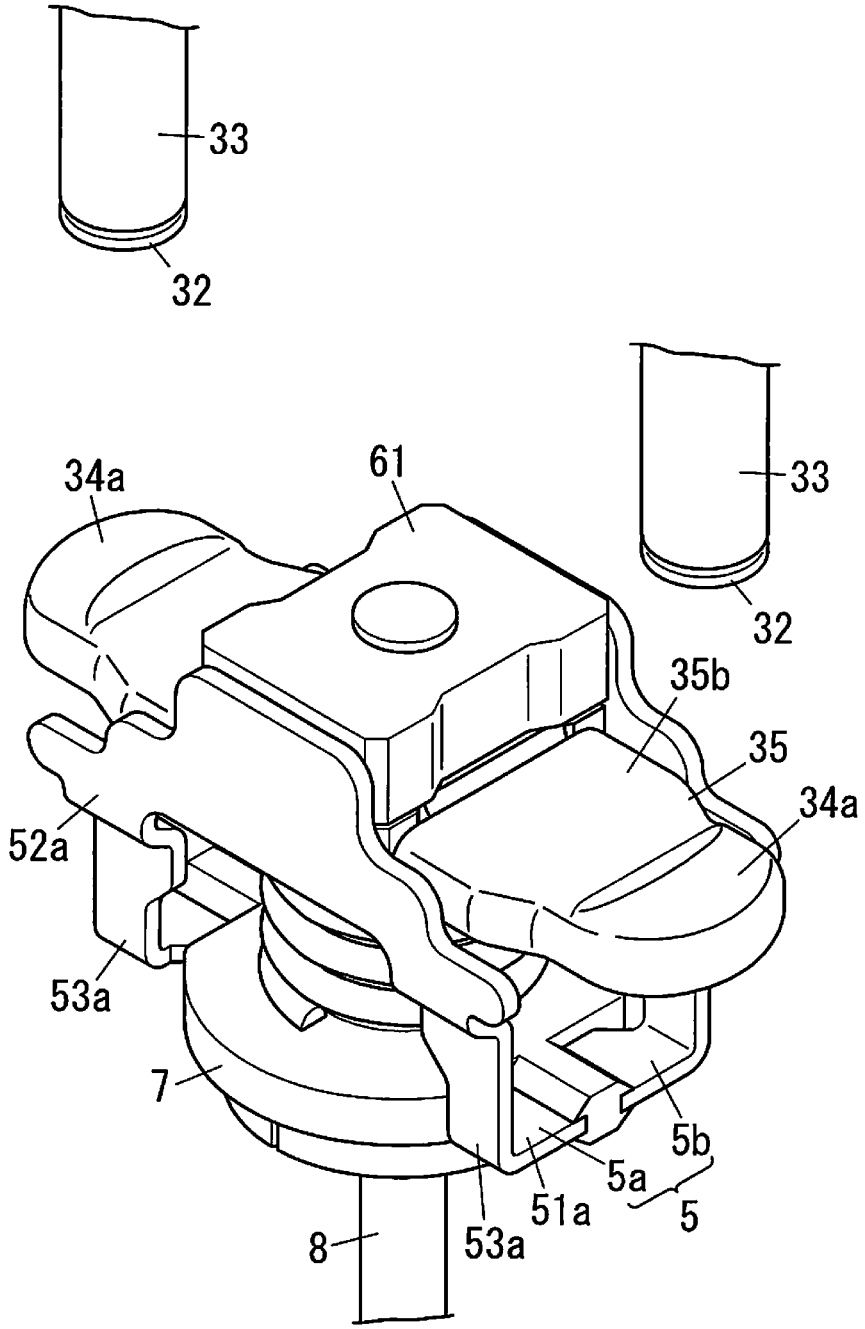
FIG. 9 is an external perspective view of another contact device according to the embodiment of the present invention.
Figure 10:
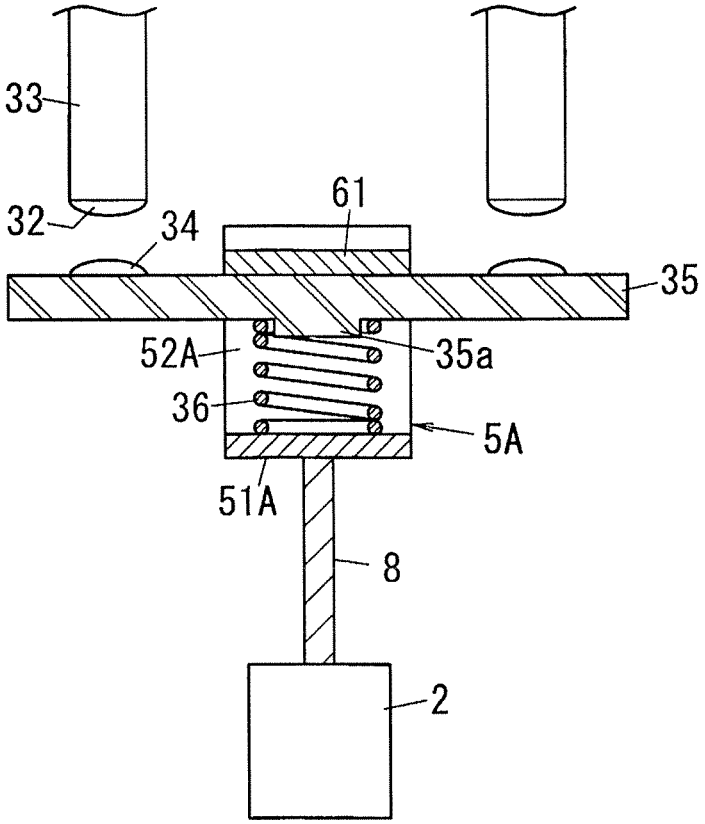
FIG. 10 PRIOR ART
FIG. 10 is a cross-sectional view of a conventional contact device.
Figure 11:
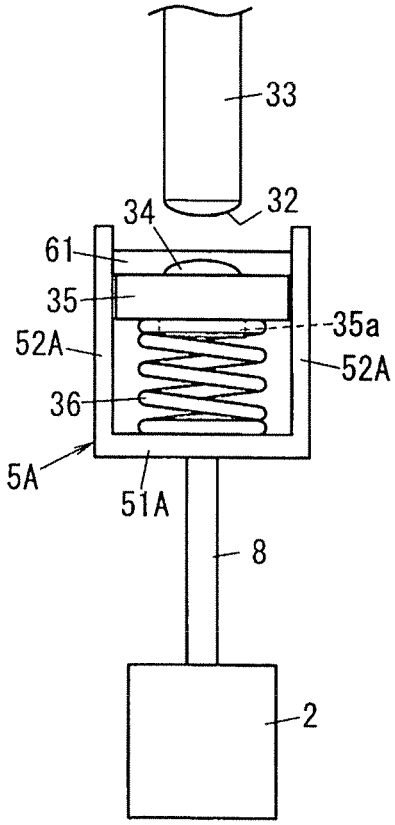
FIG. 11 PRIOR ART
FIG. 11 is a side view of the conventional contact device.

Note that, in the contact device shown in FIG. 1, although the pair of movable contacts 34 is provided separately from the movable contact maker 35, and is provided being fixed to the movable contact maker 35, the contact device of the present embodiment is not limited to the above configuration. The pair of movable contacts 34*a* may be, as shown in FIG. 9, part of the movable contact maker 35, and provided integrally with the movable contact maker 35. That is, in the movable contact maker 35 shown in FIG. 9, two ends thereof in the right and left direction (second direction) are the regions of the movable contacts 34*a*. The regions of the movable contacts 34*a* bulge toward an upper side (first side in the first direction), in the axial direction (first direction) of the movable shaft 8, that is, toward the side of the fixed contacts 32, relative to a center portion 35*b* of the movable contact maker 35. In other words, the movable contact maker 35 is formed in a recessed shape viewed from the third direction. In the contact device as shown in FIG. 9 as well, due to the movement of the movable shaft 8, the movable contact maker 35 with which the movable contacts 34*a* are integrally formed is moved, and the movable contacts 34*a* are brought into contact with and separated from the fixed contacts 32.

Although the present invention has been described in a preferred embodiment, various modifications and variations are possible by those skilled in the art without departing from the spirit or scope of this invention, that is, without departing from the claims.

The invention claimed is:

1. A spring load adjustment structure of a contact device, the contact device comprising, fixed terminals respectively comprising fixed contacts, a movable contact maker comprising, on one face thereof, movable contacts that are brought into contact with and separate from the respective fixed contacts, a pressing spring that is configured to bias the movable contact maker toward the fixed contacts, an adjuster that is opposite to the one face of the movable contact maker, a holding portion comprising a bottom that sandwiches the movable contact maker and the pressing spring with the adjuster in a moving direction of the movable contacts, and side plates that are opposite to side ends of the movable contact maker, and a driving unit that is configured to drive the movable contact maker such that the movable contacts are brought into contact with and separate from the respective fixed contacts, wherein the holding portion is divided into a first holding portion and a second holding portion, wherein the side plates comprise a first side plate provided to the first holding portion and a second side plate provided to the second holding portion, wherein the first and the second holding portions are provided in a state of being separated from each other, and by sandwiching the adjuster with the first side plate and the second side plate that are opposite to each other, the first and the second holding portions are electrically connected with each other via only the adjuster, and wherein a distance between the bottom and the adjuster is changed by moving the adjuster in extending and contracting directions of the pressing spring, and the adjuster and each of the first and second side plates are subjected to resistance welding at a position at which pressing force of the pressing spring against the movable contact maker is a predetermined value.

2. The spring load adjustment structure of a contact device according to claim 1, wherein the bottom and the pressing spring are insulated from each other.

3. The spring load adjustment structure of a contact device according to claim 2, wherein the contact device further comprises a spring receiving portion provided between the bottom and the pressing spring, and wherein the spring receiving portion is formed of a material having an electrical insulation property.

4. The spring load adjustment structure of a contact device according to claim 3, wherein the spring receiving portion comprises planar faces that are opposite to each other on outer faces.

5. The spring load adjustment structure of a contact device according to claim 3, wherein a first protrusion is formed on a first face, which opposes the second side plate, of the first side plate, and a second protrusion is formed on a second face, which opposes the first side plate, of the second side plate, and wherein the adjuster and each of the first and the second side plates are subjected to projection welding in a state in which tips of the first and second protrusions are in contact with the adjuster.

6. The spring load adjustment structure of a contact device according to claim 5, wherein a plurality of first protrusions, each of which is the first protrusion, are formed on the first side plate, and a plurality of second protrusions, each of which is the second protrusion, are formed on the second side plate.

7. The spring load adjustment structure of a contact device according to claim 5, wherein, in the first side plate, the third face that is the face opposite to the first face is formed in a planar shape, and in the second side plate, the fourth face that is the face opposite to the second face is formed in a planar shape.

8. The spring load adjustment structure of a contact device according to claim 2, wherein the holding portion comprises an opening portion opposing to the bottom in the moving direction of the movable contacts, and the adjuster that covers the opening portion is welded to each of the first and second side plates.

9. The spring load adjustment structure of a contact device according to claim 1, wherein the contact device further comprises a spring receiving portion provided between the bottom and the pressing spring, and wherein the spring receiving portion is formed of a material having an electrical insulation property.

10. The spring load adjustment structure of a contact device according to claim 9, wherein the bottom comprises a first bottom provided to the first holding portion and a second bottom provided to the second holding portion, wherein, in the first holding portion, the first bottom and the first side plate are continuous via a first bent portion, wherein, in the second holding portion, the second bottom and the second side plate are continuous via a second bent portion, wherein the spring receiving portion is provided to the bottom, and wherein the first and second bent portions are exposed from the spring receiving portion.

11. The spring load adjustment structure of a contact device according to claim 9, wherein the spring receiving portion comprises planar faces that are opposite to each other on outer faces.

12. The spring load adjustment structure of a contact device according to claim 1, wherein a first protrusion is formed on a first face, which opposes the second side plate, of the first side plate, and a second protrusion is formed on a second face, which opposes the first side plate, of the second side plate, and wherein the adjuster and each of the first and the second side plates are subjected to projection welding in a state in which tips of the first and second protrusions are in contact with the adjuster.

13. The spring load adjustment structure of a contact device according to claim 12, wherein the first protrusion is formed on a side of the first face of the first side plate by extrusion from a side of a third face, the third face being a face of the first side plate that is opposite to the first face, and the second protrusion is formed on a side of the second face of the second side plate by extrusion from a side of a fourth face, the fourth face being a face of the second side plate that is opposite to the second face.

14. The spring load adjustment structure of a contact device according to claim 12, wherein a plurality of first protrusions, each of which is the first protrusion, are formed on the first side plate, and a plurality of second protrusions, each of which is the second protrusion, are formed on the second side plate.

15. The spring load adjustment structure of a contact device according to claim 14, wherein the plurality of first protrusions are formed on a same plane of the first side plate, and the plurality of second protrusions are formed on a same plane of the second side plate.

16. The spring load adjustment structure of a contact device according to claim 12, wherein, in the first side plate, the third face that is the face opposite to the first face is formed in a planar shape, and in the second side plate, the fourth face that is the face opposite to the second face is formed in a planar shape.

17. The spring load adjustment structure of a contact device according to claim 1, wherein the holding portion comprises an opening portion opposing to the bottom in the moving direction of the movable contacts, and the adjuster that covers the opening portion is welded to each of the first and second side plates.

18. The spring load adjustment structure of a contact device according to claim 1, wherein the adjuster is coated by plating.

19. The spring load adjustment structure of a contact device according to claim 1, wherein the adjuster is formed of a magnetic material, and the holding portion is formed of a non-magnetic material.

20. A spring load adjustment method of a contact device, the contact device comprising, fixed terminals respectively comprising fixed contacts, a movable contact maker comprising, on one face thereof, movable contacts that are brought into contact with and separate from the respective fixed contacts, a pressing spring that is configured to bias the movable contact maker toward the fixed contacts, an adjuster that is opposite to the one face of the movable contact maker, a holding portion comprising a bottom that sandwiches the movable contact maker and the pressing spring with the adjuster in a moving direction of the movable contacts, and side plates that are opposite to side ends of the movable contact maker, and a driving unit that is configured to drive the movable contact maker such that the movable contacts are brought into contact with and separate from the respective fixed contacts, wherein the holding portion is divided into a first holding portion and a second holding portion, wherein the side plates comprise a first side plate provided to the first holding portion and a second side plate provided to the second holding portion, wherein the first and the second holding portions are provided in a state of being separated from each other, and by sandwiching the adjuster with the first side plate and the second side plate that are opposite to each other, the first and the second holding portions are electrically connected with each other via only the adjuster, and wherein a distance between the bottom and the adjuster is changed by moving the adjuster in extending and contracting directions of the pressing spring, and the adjuster and each of the first and second side plates are subjected to resistance welding at a position at which pressing force of the pressing spring against the movable contact maker is a predetermined value.

* * * * *